United States Patent [19]

Mears

[11] 4,215,751

[45] Aug. 5, 1980

[54] FINISH PLATE ASSEMBLY FOR A SPRINKLER HEAD HAVING INTERENGAGING RAMP AND ARM ELEMENTS

[75] Inventor: James W. Mears, Warwick, R.I.

[73] Assignee: Grinnell Fire Protection Systems Company, Inc., Providence, R.I.

[21] Appl. No.: 939,396

[22] Filed: Sep. 5, 1978

[51] Int. Cl.[2] ..... A62C 37/10

[52] U.S. Cl. ..... 169/51; 169/37; 220/302; 248/345; 285/46

[58] Field of Search ..... 169/37–41, 169/90, 26, 51; 52/221; 248/343, 345; 126/317; 285/46, 360, 376, 401; 220/293, 298, 301, 302; 292/303

[56] References Cited

U.S. PATENT DOCUMENTS

| | | | |
|---|---|---|---|
| 1,507,758 | 9/1924 | Scott | 248/345 |
| 1,762,852 | 6/1930 | Zarobsky | 220/302 |
| 2,211,399 | 8/1940 | Winslow | 169/39 |
| 3,130,790 | 4/1964 | Hodgman | 169/40 |
| 3,998,273 | 12/1976 | Juliano | 169/37 |
| 4,066,129 | 1/1978 | Anderson | 169/37 |
| 4,117,887 | 10/1978 | Anderson | 285/46 X |

*Primary Examiner*—Robert Spar
*Assistant Examiner*—Fred A. Silverberg

[57] ABSTRACT

A finish plate assembly for giving a finished appearance to a fire-protection sprinkler head exposed through an opening in a ceiling wherein the installed height and angular orientation of the ceiling with respect to the sprinkler head is variable, thereby determining a range of variation of relative distances normal to the ceiling between adjacent portions of the opening and the sprinkler head, the assembly including a finish plate having a planar contact surface for engagement with the ceiling outside the periphery of the opening and having two or more arms each with a radially-extending segment, and further including a receptor fixed to the sprinkler head, the receptor including openings for receiving the arm segments when the finish plate and arms are moved upward toward the fixed receptor, two or more circumferentially-extensive, resilient ramp elements for attachment around the sprinkler head, and a central opening for receiving the sprinkler head, and the resiliency of the ramp elements being selected to maintain contact between the contact surface and the ceiling despite, with passage of time, further variation of the relative distances within the range.

10 Claims, 6 Drawing Figures

FINISH PLATE ASSEMBLY FOR A SPRINKLER HEAD HAVING INTERENGAGING RAMP AND ARM ELEMENTS

BACKGROUND OF THE INVENTION

This invention relates to providing a visually pleasing finish to openings in room surfaces, e.g., ceilings, surrounding pre-mounted units such as fire sprinklers which extend to or through the room surface.

Fire protection systems usually comprise horizontal runs of water supply piping and vertical stub pipes, referred to as drops, which are intended to position the sprinklers at or near the ceiling level. Typically, in new construction the fire protection system is installed before the ceiling because the fire system is located above the ceiling, and to provide fire protection during construction. It is customary to install a finish plate covering the opening in the ceiling surrounding the sprinkler after the ceiling has been installed.

A recurring problem is that ceilings are not installed with precision with respect to the sprinklers, nor are the sprinklers installed at a uniform height from the floor, so that there is variation in the locations of the sprinklers with respect to the ceiling, in both their relative vertical positions and in the angle between the vertical stub pipes and the plane of the ceiling.

Some of the presently available finish plate fixtures do not adapt to the plane of ceiling, e.g., when the ceiling is slanted, others do not allow adjustment for vertical spacing between the ceiling and fixture, and others require the fire system to be drained and the sprinkler removed to install the finish plate.

SUMMARY OF THE INVENTION

The present invention provides a novel finish plate assembly providing automatic adaption to variations in the relative vertical and angular positions of a pre-mounted unit, such as a sprinkler, and a room surface, such as a ceiling. The assembly is simple and inexpensive to manufacture and install and does not require removal of the sprinkler from the drop when installing the finish plate.

The finish plate assembly has a finish plate member with a plurality of circumferentially spaced, radially extending arms. A corresponding plurality of independently acting resilient ramp elements are attached to the pre-mounted unit at a location above the ceiling. The ramp elements define upwardly extending sloping surfaces which extend upwardly by a greater distance than the expected range of misalignment between the ceiling and the unit; the sloping surfaces are deflectable downwardly by a greater distance than the expected range of misalignment. The arms of the finish plate member are brought into engagement with the sloping surfaces of the resilient ramp elements as the finish plate is rotated into place during installation, and are forced upwardly until the finish plate member engages the ceiling. Thereafter, as the rotation continues, the sloping surfaces are deflected downwardly and react against the arms to resiliently bias the finish plate in engagement with the ceiling for any misalignment within the expected range. The independent action of the resilient ramp elements allows the finish plate to adapt to the angle of the ceiling with respect to the drop. After a given amount of rotation, the arms engage detents in the ramp elements, which lock the finish plate in engagement with the ceiling. The resilient ramp elements then allow adaption to later changes in the relative positions of the unit and the ceiling. In a preferred embodiment, the resilient ramp elements comprise a single, annular spring formed from flat stock and bent into a saddle-like shape, and the detents are formed by offsets formed in the spring. The spring is attached to an annular mounting plate which is in turn mounted on the unit. In a preferred embodiment, there are two diametrically opposed arms and corresponding notches in the circumferential edges of the mounting plate and spring to allow the arms to pass from the lower to the upper sides of the mounting plate and spring to engage the sloping surfaces; the notches also allow the mounting plate to be engaged by a spanner wrench when threading the sprinkler unit onto the drop. Other important features are taught in the following description.

DESCRIPTION OF THE EMBODIMENT

Drawings

FIG. 1 is a perspective view of the finish plate assembly on a ceiling mounted sprinkler unit before installation of the finish plate member.

FIGS. 2, 2A, and 2B are side views, partly in section, of the finish plate assembly during installation of the finish plate.

Description

Figure 1:
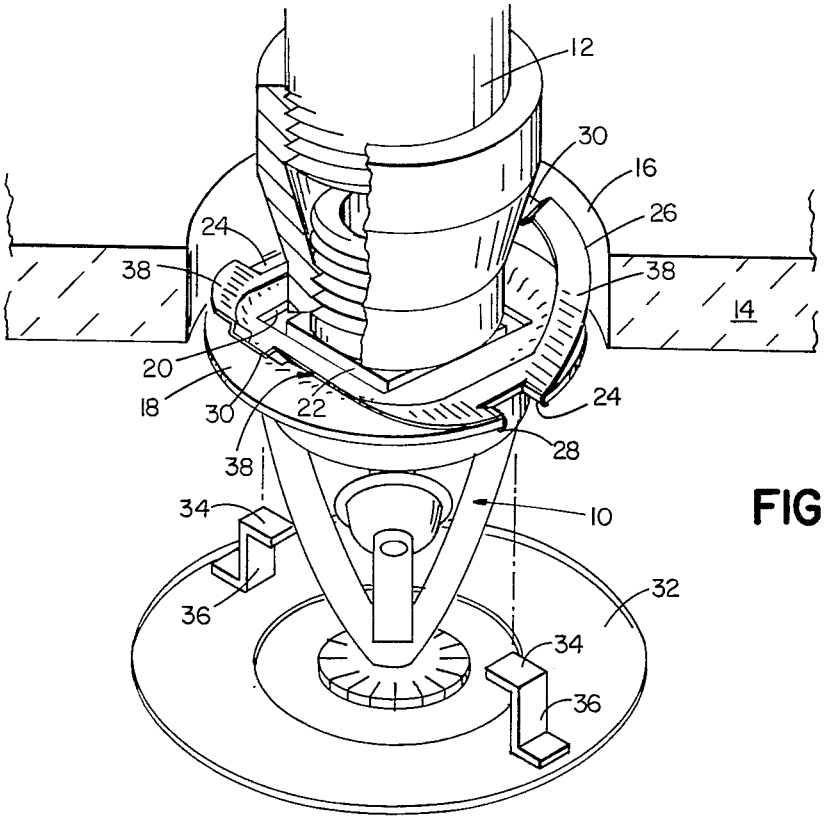

Referring to FIG. 1, sprinkler unit 10 is connected to the lower end of vertical drop pipe 12, which in turn is connected to a horizontal run of pipe (not shown) which provides water to a number of drops and sprinkler units. Ceiling 14 is installed at a later time, with opening 16 surrounding unit 10. There may be variations of up to ½ inch between the desired and actual relative positions of the ceiling and unit; similarly, the ceiling may not be at right angles to the drop.

A receptor comprising a mounting plate 18 and a spring element 26 is fixed to the upper end of unit 10. Mounting plate 18 has a square opening 20 sized to fit closely over square section 22 of unit 10. Notches 24 in the rim of the mounting plate allow the sprinkler unit to be gripped by a spanner wrench when it is screwed onto drop pipe 12. A smooth-finished hub 19 is formed in the central part of mounting plate 18 and has a vertical sidewall 21 corresponding to the range of adjustable positions that the finish plate may take.

Spring element 26 is preferably formed as a stamping from beryllium-copper sheet stock and is thereafter bent to have a saddle-like form. Spring 26 is mounted to mounting plate 18 by tabs 28 which engage notches 24 in the mounting plate, and offset portions 30 of the spring element provide detents for locking finish plate 32 in the installed position, as described below.

Annular finish plate 32 has an inner diameter greater than the outer diameter of unit 10 and an outer diameter greater than that of opening 16. Arms 34 extend radially inwards from the top edges of arm supports 36 which, in turn, are attached to the upper side of plate 32.

Figure 3:
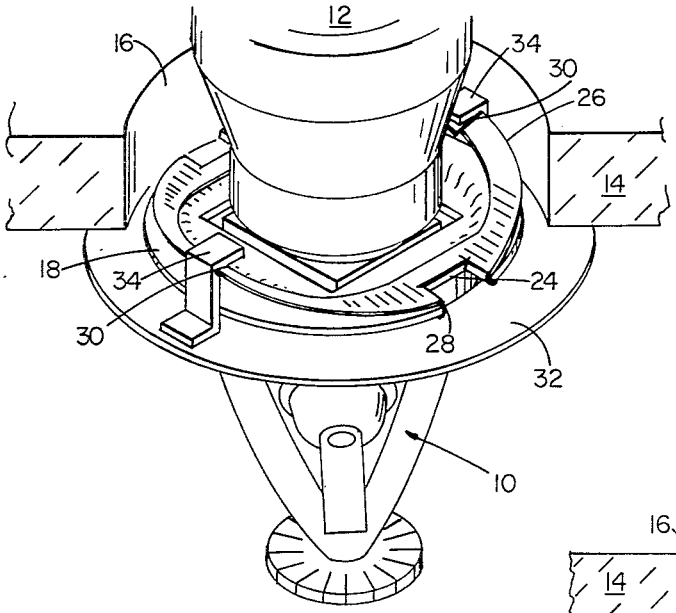
FIG. 3 is the view of FIG. 1 with the finish plate member installed.
Figure 2:
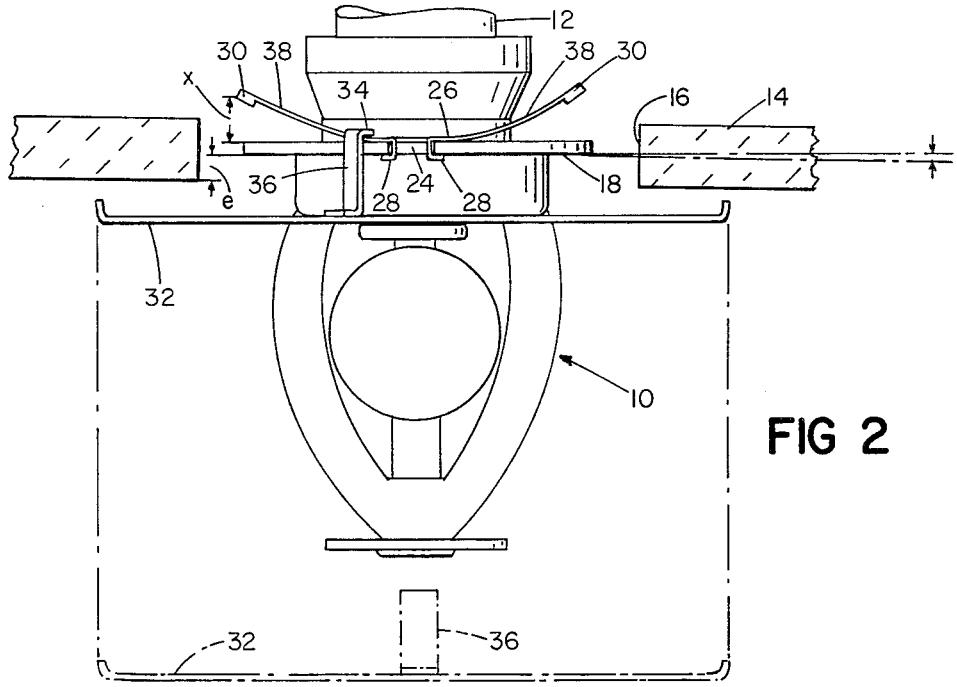
Figure 2A:
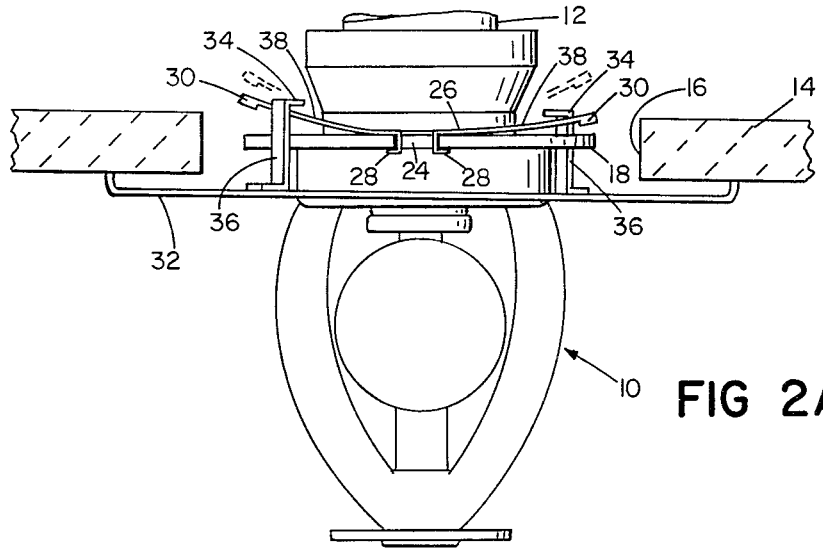
Figure 2B:
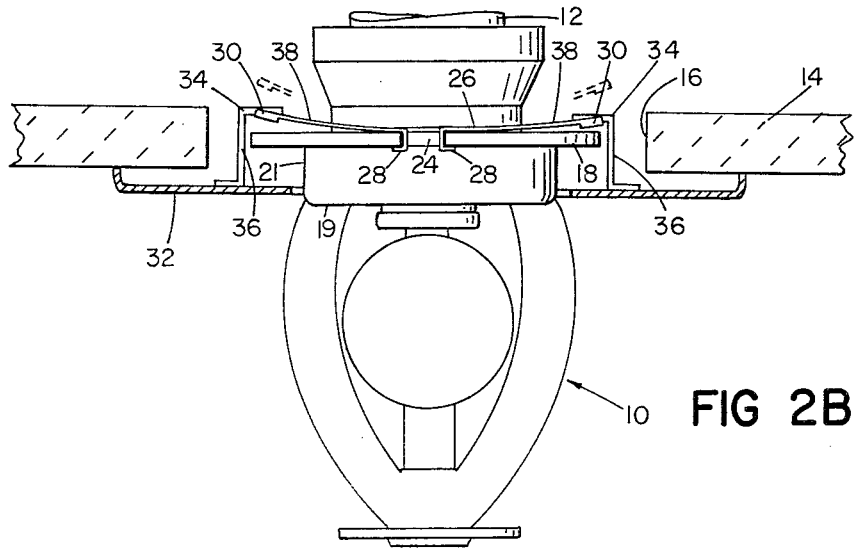

Referring to FIG. 2, finish plate 32 is installed by moving it upwards over unit 10 until arms 34 pass through notches 24 in mounting plate 18. Plate 32 is then rotated and, as shown in FIG. 2, the arms engage independently acting, upwardly extending, circumferential, sloping surfaces 38 of spring element 26. The arms move up the sloping surfaces of the spring until plate 32 comes into contact with ceiling 14. As shown in FIG. 2A, the plate continues to be rotated and portions 38 of the spring are independently deflected downwardly by the sliding arms 34, causing the plate to align itself in face to face engagement with the ceiling and to bear with increasing spring force against the ceiling. The plate is rotated until, as shown in FIGS. 2B and 3, the arms engage the detents provided by offset portions 30 of the spring, locking the finish plate in the installed position, a position which will vary relative to unit 10, depending upon the placement of the ceiling. The side 21 of hub 19 of the mounting plate 18 will be more or less revealed below the finish plate depending upon the installed position, in all cases serving to blend in with the finish plate 32 to provide an overall smooth, finished appearance.

The vertical extension X of the spring, and distance over which the spring can deflect, is selected to exceed the range of variation expected to occur between the locations of the sprinkler unit and the ceiling, e.g., ¼ inch in the embodiment shown above. The spring then, in accordance with the invention, exerts force over the entire range of locations of the ceiling with respect to the sprinkler unit, to maintain the finish plate firmly against the ceiling, both at the time of installation and in the event of later changes in the position of the unit or ceiling, e.g., due to settling. The independent operation of the sloping surfaces of the spring allows the finish plate to similarly adapt to variations in the angle between the ceiling and the vertical stub pipe. The strength of the spring is selected to maintain contact between the finish plate and the ceiling without forcing either out of position; in the preferred embodiment, this spring force at maximum deflection of the spring is less than one pound.

Figure 4:
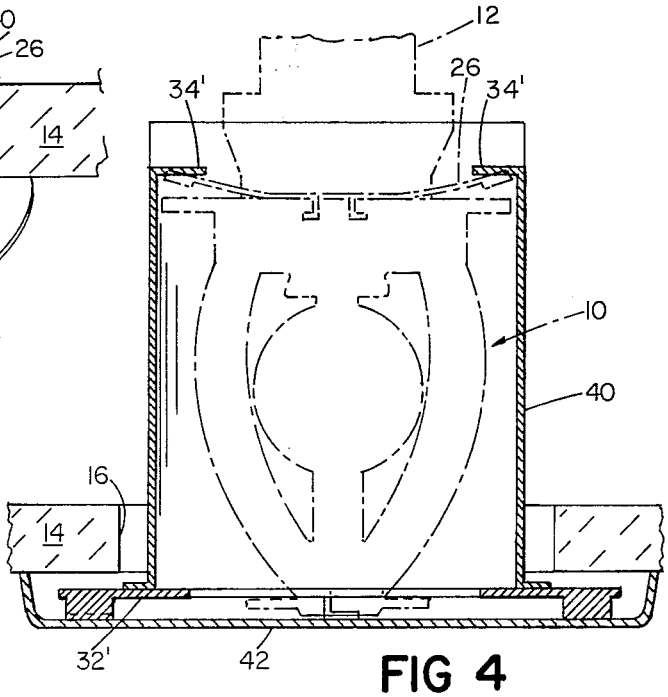
FIG. 4 is a perspective sectional view of another embodiment of a finish plate assembly, including a concealment plate.

Another preferred embodiment of the finish plate is shown in FIG. 4 for use where the sprinkler unit is recessed, i.e., above or within the thickness of the ceiling. Cylindrical extension 40 extends upwards from the inner edge of finish plate 32', with arms 34' extending radially inwards from the upper portion of extension 40.

As shown in FIG. 4, the opening in plate 32' below sprinkler unit 10 is covered, to conceal the sprinkler unit, by concealment plate 42. Plate 42 is attached to the finish plate by solder having a low melting temperature, which melts to allow the concealment plate to drop free and expose the sprinkler in the event of a fire.

In other embodiments, not shown, the mounting plate is secured to the sprinkler unit by spring tab extensions from spring element 26, spring element 26 can be formed from spring wire rather than flat stock material, and spring 26 can be made from materials other than beryllium-copper. Also, the finish plate can be mounted to the mounting plate and spring by more than two arms, but preferably in a symmetrical, balanced array, with a corresponding change in the number and location of the notches in the mounting plate and spring and the number and location of upwardly sloping spring surfaces 38.

What is claimed is:

1. A finish plate assembly for giving a finished appearance to a fire-protection sprinkler head that is exposed through an opening in a room surface such as a suspended ceiling wherein the installed height and angular orientation of said ceiling with respect to a preinstalled sprinkler head is variable, thereby determining a range of variation of relative distances normal to said ceiling between adjacent portions of said opening and said sprinkler head, said assembly comprising:

a finish plate member, said member including an exposed exterior surface of sufficient width to extend beyond the periphery of said opening, an interior surface for orientation toward said ceiling, said interior surface including a planar contact surface for engagement with said ceiling outside the periphery of said opening, and two or more arms each having a radially-extending segment; and a receptor fixed to said sprinkler head, said receptor including openings for receiving said arm segments when said finish plate member and arms are moved upward toward said fixed receptor, two or more circumferentially-extensive, resilient ramp elements for attachment around said sprinkler head, and a central opening for receiving said sprinkler head, each of said ramp elements having a top surface defining an upwardly-sloping surface for engaging a bottom surface of one of said radially-extending arm segments and urging said finish plate member upwardly by an increasing amount as said finish plate member is rotated about its axis in relation to said fixed receptor during installation, the upward extent of each said sloping surface being greater than said range of variation, said resilient ramp elements being downwardly deflectable with further rotation of said finish plate member after said contact surface of said finish plate member engages said ceiling, and the resiliency of said ramp elements being selected to maintain contact between said contact surface and said ceiling despite, with passage of time, further variation of said relative distances within said range.

2. The finish plate assembly of claim 1 wherein said receptor further comprises a mounting plate attached to said unit, said resilient ramp element being mounted on said mounting plate.

3. The finish plate assembly of claim 2 wherein said mounting plate includes a finish hub having a vertical extent constructed to protrude through said finish plate a varying distance depending upon the installed position of said finish plate.

4. The finish plate assembly of claim 1 wherein said resilient ramp elements comprise a single annular spring, said spring having a plurality of alternately facing upward and downward curves for providing said upwardly extending sloping surfaces.

5. The finish plate assembly of claim 4 wherein said spring further includes a vertically downwardly offset portion of said spring at the most upwardly point of said upward curve to provide a detent.

6. The finish plate assembly of claim 1 wherein said finish plate member further comprises a plurality of upwardly extending circumferentially spaced support elements, each said support element corresponding to a said circumferentially spaced arm, said arms extending radially inwardly from the upper edges of said support elements.

7. The finish plate assembly of claim 1 wherein said finish plate member further comprises an annular extension extending upwardly from said annular plate.

8. The finish plate assembly of claim 7 wherein said arms extend radially inwardly from the upper edge of said annular extension.

9. The finish plate assembly of claim 7 wherein said finish plate member further comprises a concealment plate adapted to be heat-releasably mounted to said annular plate, said concealment plate extending across the inner opening in said annular plate and concealing said unit from view.

10. The finish plate assembly of claim 9 wherein said concealment plate is attached to said annular plate by low melting temperature solder.

* * * * *